US005181670A

United States Patent [19]

Eaton et al.

[11] Patent Number: 5,181,670

[45] Date of Patent: Jan. 26, 1993

[54] STORAGE APPARATUS FOR STORING A NECKTIE

[75] Inventors: Douglas G. Eaton, 3206 Yorkshire Ct., Bloomington, Ill. 61704; Robert D. Wallace, Bethany, Okla.

[73] Assignee: Douglas G. Eaton, Bloomington, Ill.

[21] Appl. No.: 824,616

[22] Filed: Jan. 23, 1992

[51] Int. Cl.[5] ..... B65H 16/02; B65D 85/18

[52] U.S. Cl. ..... 242/67.1 R; 206/296; 206/298; 242/96

[58] Field of Search ..... 206/278, 292, 296, 298, 206/293; 242/96, 85, 67.1 R, 71.1; 220/306

[56] References Cited

U.S. PATENT DOCUMENTS

| | | | |
|---|---|---|---|
| 1,537,703 | 5/1925 | Fisk . | |
| 1,878.400 | 9/1932 | Irschik . | |
| 2,352,427 | 6/1944 | Gantt . | |
| 2,865,071 | 12/1958 | Clemens | 242/100.1 |
| 3,042,273 | 7/1962 | Baver et al. | 220/306 X |
| 3,131,805 | 5/1964 | Gardner . | |
| 3,664,594 | 5/1972 | Novak | 242/67.1 R |
| 4,883,236 | 11/1989 | Niedospial, Jr. et al. | 242/71.1 |

FOREIGN PATENT DOCUMENTS 845602 8/1952 Fed. Rep. of Germany ..... 206/293

*Primary Examiner*—Bryon P. Gehman

*Attorney, Agent, or Firm*—Dunlap, Codding & Lee

[57] ABSTRACT

A storage apparatus for storing a necktie which includes a case and a lid with a first and a second tie rod connected to the lid. The case has a case opening which extends through the case forming a storage space. The case has a case length extending between a first and a second end of the case. A base is connected to the second end of the case forming a closed second end. The first and the second tie rods each are connected to the lid and each of the tie rods extends a distance from the lid. The first and the second tie rods each have a rod length which is less than the case length so that the ends of the first and the second rods each are spaced a distance from the base when the lid with the tie rods connected thereto is inserted into the case. The necktie is rolled about the tie rods and stored in the storage space in the case.

7 Claims, 3 Drawing Sheets

STORAGE APPARATUS FOR STORING A NECKTIE

FIELD OF THE INVENTION

The present invention relates to a storage apparatus for storing a necktie wherein the necktie is wound about tie rods connected to a lid and the lid is removably connectable to a case, the necktie wrapped about the tie rods being stored in a case opening formed in the case and the tie rods being spaced a distance from a base connected to a second end of the case when the lid is connected to the case and the tie rods being spaced a distance apart and connected only by virtue of the fact that each of the tie rods is connected to the lid.

DESCRIPTION OF THE PREFERRED EMBODIMENTS

Figure 6:
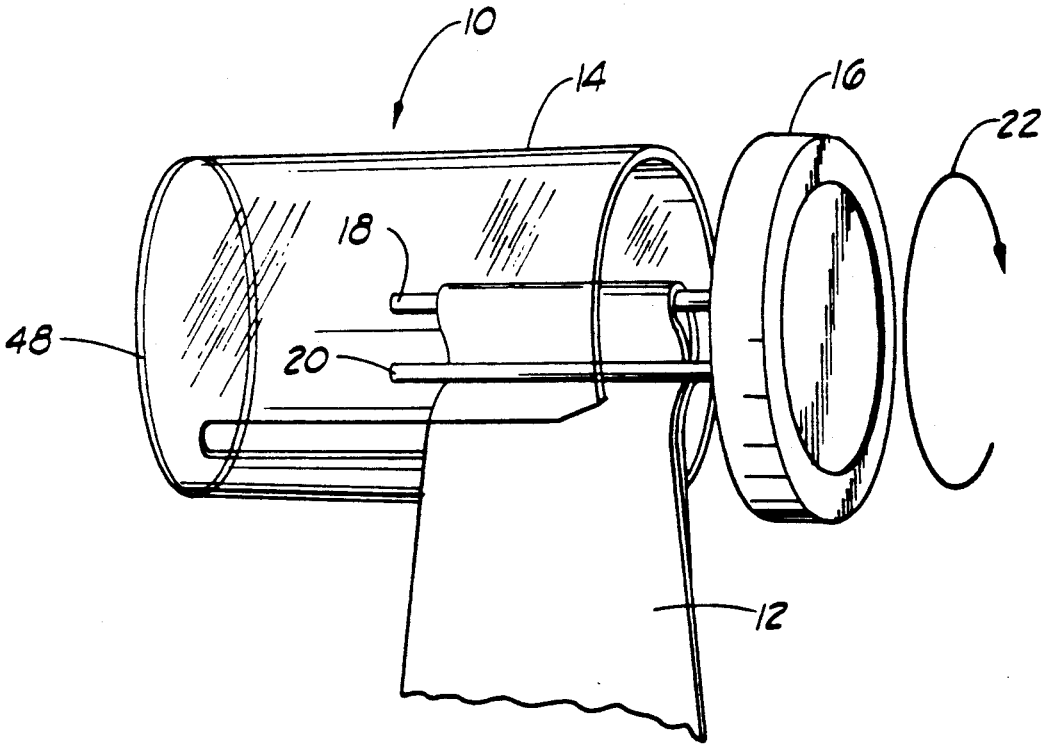
FIG. 6 is a partial perspective view of the case with the lid being moved into a position connected to the case and with a necktie wrapped around a portion of the tie rods connected to the lid.

As shown in FIG. 6, the present invention relates to a storage apparatus 10 for storing a necktie 12. In general, the storage apparatus 10 consists of a case 14 and a lid 16 with a first and a second tie rod 18 and 20 connected thereto.

In operation, the necktie 12 is looped over one of the tie rods 18 or 20 (the necktie 12 being shown in FIG. 6 looped over the tie rod 18) to a position wherein about half of the necktie 12 extends from one side of the tie rod 18 or 20 and the other half of the necktie 12 extends from the other tie rod 18 or 20. In this position, the lid 16 with the necktie 12 connected thereto is disposed on the case 14 with the first and the second tie rods 18 and 20 and the necktie 12 connected thereto being disposed in a portion of the case 14. The lid 16 then is rotated in a direction 22 thereby wrapping the necktie 12 about the tie rods 18 and 20. The lid 16 is turned or rotated in the direction 22 until the necktie 12 has been completely wrapped around the tie rods 18 and 20 and the tie rods 18 and 20 with the necktie 12 wrapped thereabout is disposed in the case 14.

The case 14 with the necktie 12 disposed therein wrapped about the tie rods 18 and 20 provides a convenient storage for the necktie 12 whereby the case 14 with the necktie 12 disposed therein can be inserted in a suitcase for traveling, for example. When it is desired to use the necktie 12, the necktie 12 simply is unwrapped from the tie rods 18 and 20 and disconnected from the tie rod 18 or 20. The wrapping of the necktie 12 about the tie rods 18 and 20 and the storing of the necktie 12 in the case 14 prevents the necktie 12 from substantially creasing during a storage period of time.

Figure 1:
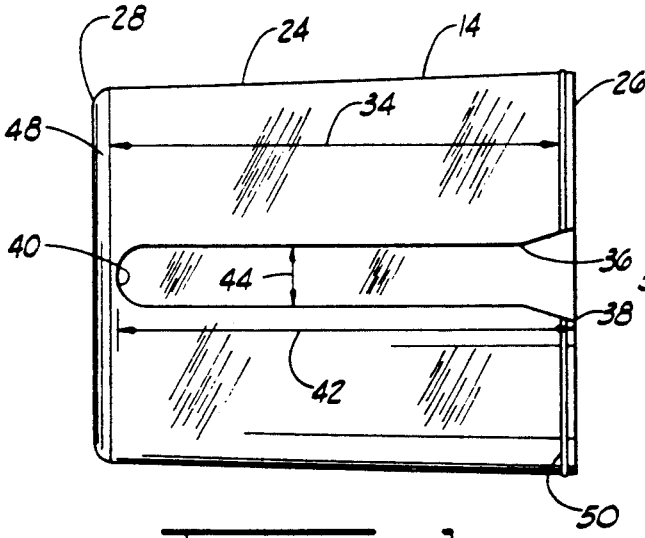
FIG. 1 is a side elevational view of a case portion of the storage apparatus of the present invention.
Figure 2:
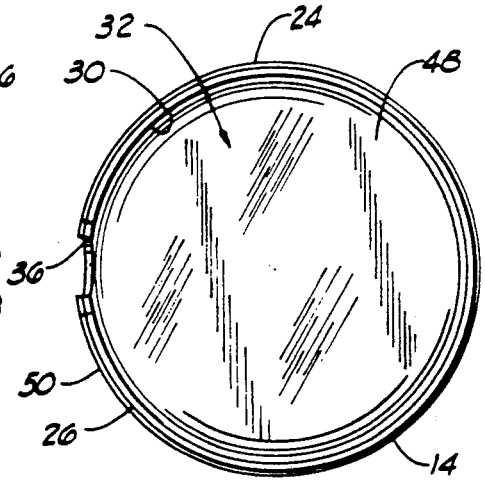
FIG. 2 is a top plan view of the case shown in FIG. 1.

The case 14 is shown in more detail in FIGS. 1 and 2. As shown in FIGS. 1 and 2, the case 14 is cylindrically shaped and constructed of a transparent, preferably plastic material. The case 14 has an outer peripheral surface 24, a first end 26 and a second end 28.

A case opening 30 extends through the first end 26 of the case 14. The case opening 30 extends a distance through the case 30 generally toward the second end 28. The case opening 30 forms a storage space 32 within the case 14. The case 14 has a case length 34 extending between the first end 26 and the second end 28.

A tie slot 36 is formed in the case 14. The tie slot 36 extends through the first end 26 of the case 14 and extends a distance generally toward the second end 28 of the case 14. The tie slot 36 is spaced a distance from the second end 28 of the case 14. The tie slot 36 intersects the outer peripheral surface 24 of the case 14 and intersects the storage space 32 in the case 14. The tie slot 36 has a first end 38 and a second end 40. The first end 38 of the tie slot 36 intersects the first end 26 of the case 14 and the second end 40 of the tie slot 36 is spaced a distance 42 from the second end 28 of the case 14.

The tie slot 36 has a slot width 44 and a slot length 46 with the slot length 46 extending generally between the first and the second ends 38 and 40 of the tie slot 36. The slot width 44 and the slot length 46 are sized to slidingly receive the necktie 12.

A circularly shaped base 48 is connected to the second end 28 of the case 14. The base 48 encloses the second end 28 of the case 14. The case length 34 more particularly extends between the first end 26 and the base 48. In one embodiment, the base 48 is formed integrally with the case 14.

A snap flange 50 (FIGS. 1 and 5) is formed on the outer peripheral surface 24 of the case 14. The snap flange 50 extends a distance radially outwardly from the outer peripheral surface 24 of the case 14. The snap flange 50 is spaced a distance 52 (FIG. 5) from the first end 26 of the case 14. The snap flange 50 extends circumferentially about the case 14. The snap flange 50 is adapted to cooperate in snappingly connecting the lid 16 to the case 14.

Figure 4:
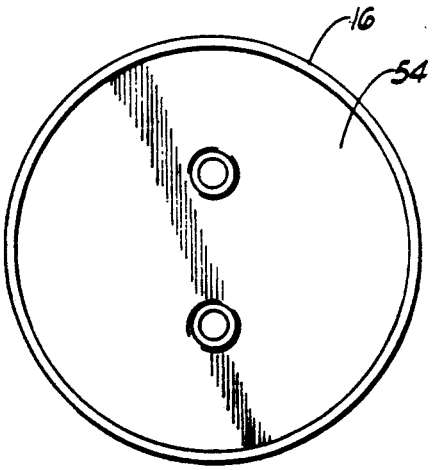
FIG. 4 is a top plan view of the lid portion of FIG. 3.
Figure 3:
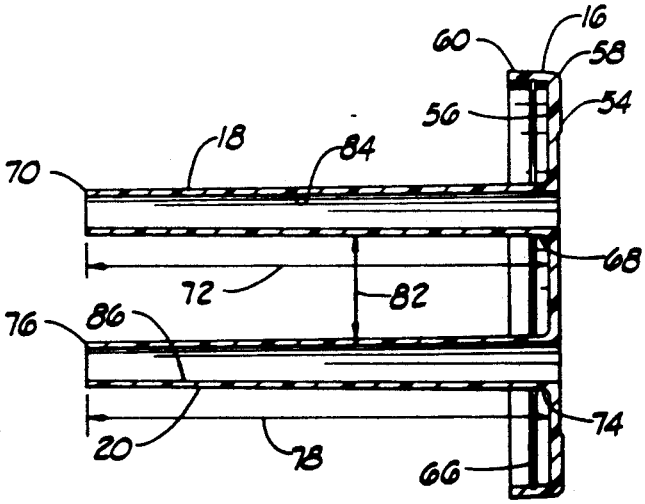
FIG. 3 is a sectional view of a lid portion of the storage apparatus of the present invention, taken substantially along the lines 3—3 of FIG. 4.

As shown in FIGS. 3 and 4, the lid 16 is circularly shaped. The lid 16 has an upper surface 54, a lower surface 56 and an outer peripheral surface 58. A lid flange 60 (FIGS. 3 and 5) is connected to the outer peripheral surface 58 of the lid 16. The lid flange 60 extends circumferentially about the lid 16. The lid flange 60 extends a distance generally perpendicularly from the lower surface 56 of the lid 16.

Figure 5:
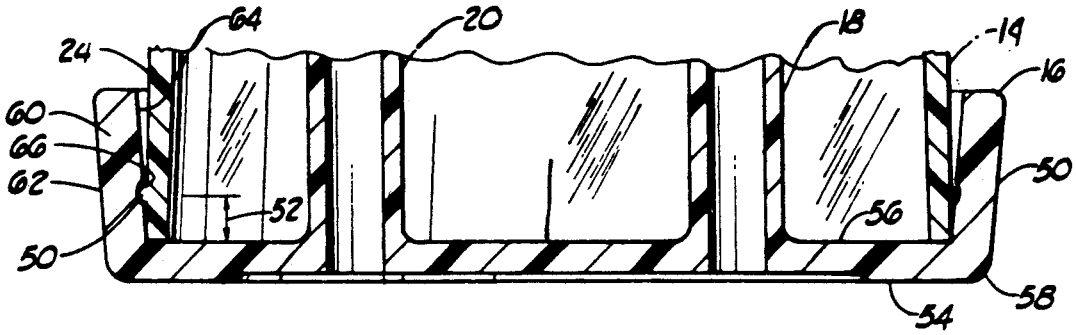
FIG. 5 is a sectional view of the lid connected to the case, only a portion of the case being shown in FIG. 5.

The lid flange 60 has an outer surface 62 (FIGS. 3 and 5) and an inner surface 64 (FIGS. 3 and 5). A snap recess 66 (FIG. 3 and 5) is formed in the inner surface 64 of the lid flange 60. The snap recess 66 extends circumferentially about the lid flange 60. The snap recess 66 is shaped and adapted to snappingly receive the snap flange 50 when the lid 16 is snappingly connected to the case 14.

The first and the second tie rods 18 and 20 each are connected to the lower surface 56 of the lid 16.

As shown in FIG. 3, the first tie rod 18 has a first end 68 and a second end 70. The first end 68 of the first tie rod 18 is connected to the lower surface 56 of the lid 16. The first tie rod 18 extends perpendicularly a distance from the lower surface 56 of the lid 16. The first tie rod 18 has a first rod length 72 extending between the first and the second ends 68 and 70 of the first tie rod 18.

The second tie rod 20 has a first end 74 and a second end 76. The first end 74 of the second tie rod 20 is connected to the lower surface 56 of the lid 16. The second tie rod 20 extends perpendicularly a distance from the lower surface 56 of the lid 16. The second tie rod 20 has a second rod length 78 extending between the first and the second ends 74 and 76 of the second tie rod 20.

Figure 7:
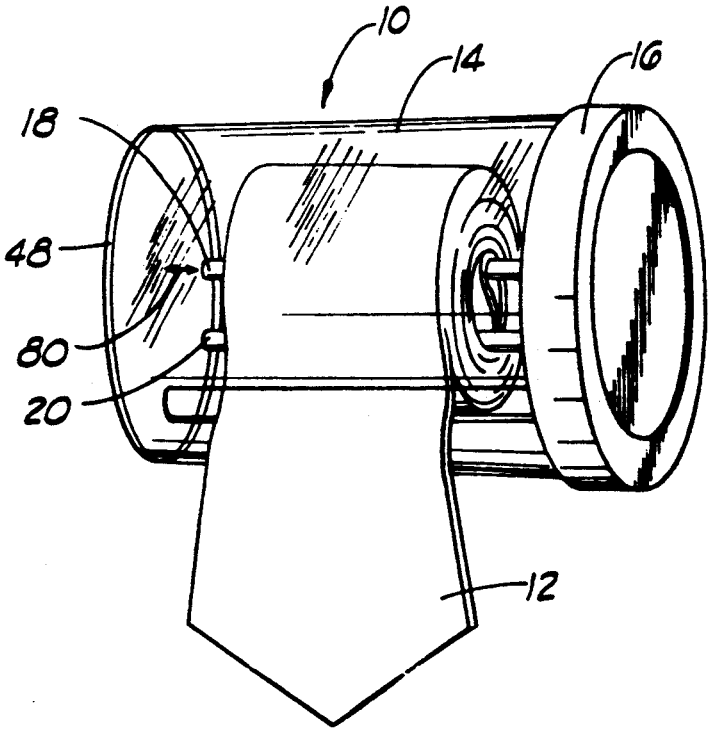
FIG. 7 is a view of the lid connected to the case with the necktie partially wrapped around the tie rods.

The first rod length 72 is the same as the second rod length 78. The second ends 70 and 76 of the respective tie rods 18 and 20 each are spaced a distance 80 (FIG. 7) from the base 48 or, in other words, from the second end 28 of the case 14 when the lid 16 is connected to the case 14. The first tie rod 18 is spaced a distance 82 (FIG. 3) from the second tie rod 20. The first and the second tie rod 20. The first and the second tie rods 18 and 20 are not directly connected together; however, the first and the second tie rods 18 and 20 each are connected to the lid 16 with the lid 16 providing the sole connection between the first and the second tie rods 18 and 20.

An first opening 84 (FIG. 3) extends through the first tie rod 18 intersecting the first and the second ends 68 and 70 of the first tie rod 18 and intersecting the upper and the lower surfaces 54 and 56 of the lid 16. A second opening 86 (FIG. 3) extends through the second tie rod 20 intersecting the first and the second ends 74 and 76 of the second tie rod 20 and intersecting the upper and the lower surfaces 54 and 56 of the lid 16. In a preferred form, the lid 16 and the first and the second tie rods 18 and 20 are integrally formed in a single, unitary structure.

In operation, the necktie 12 initially is wrapped about the first tie rod 18 or the second tie rod 20 or both to a position wherein about one-half of the necktie 12 extends a distance from one side of the tie rods 18 and 20 and the other half of the necktie 12 extends a distance from the other side of the tie rods 18 and 20. In this position, the lid 16 with the tie rods 18 and 20 connected thereto and with the necktie 12 initially wrapped about one or both of the tie rods 18 and 20 is moved to a position wherein the first and the second tie rods 18 and 20 with the necktie 12 connected thereto are positioned and disposed in the storage space 32. As the lid 16 with the necktie 12 draped over one or both of the tie rods 18 and 20 is moved toward the storage space 32, the necktie 12 passes through and extends through the tie slot 36.

The lid 16 is moved to a position wherein the snap flange 50 is snappingly connected to the snap recess 66. In this position, the lid 16 is rotated to wind the necktie 12 around the first and the second tie rods 18 and 20 with the snap recess 66 slidingly engaging the snap flange 50 as the lid 16 is being rotated. The lid 16 is rotated until the necktie 12 has been completely wrapped around the first and the second tie rods 18 and 20.

When it is desired to use the necktie 12, the lid 16 is removed from the case 14 and the necktie 12 is unwound from the tie rods 18 and 20. In the alternative, the lid 16 does not have to be removed. The necktie 12 simply can be slipped of the tie rods 18 and 20 by pulling the necktie 12 through the tie slot 36.

EMBODIMENT OF FIG. 8

Figure 8:
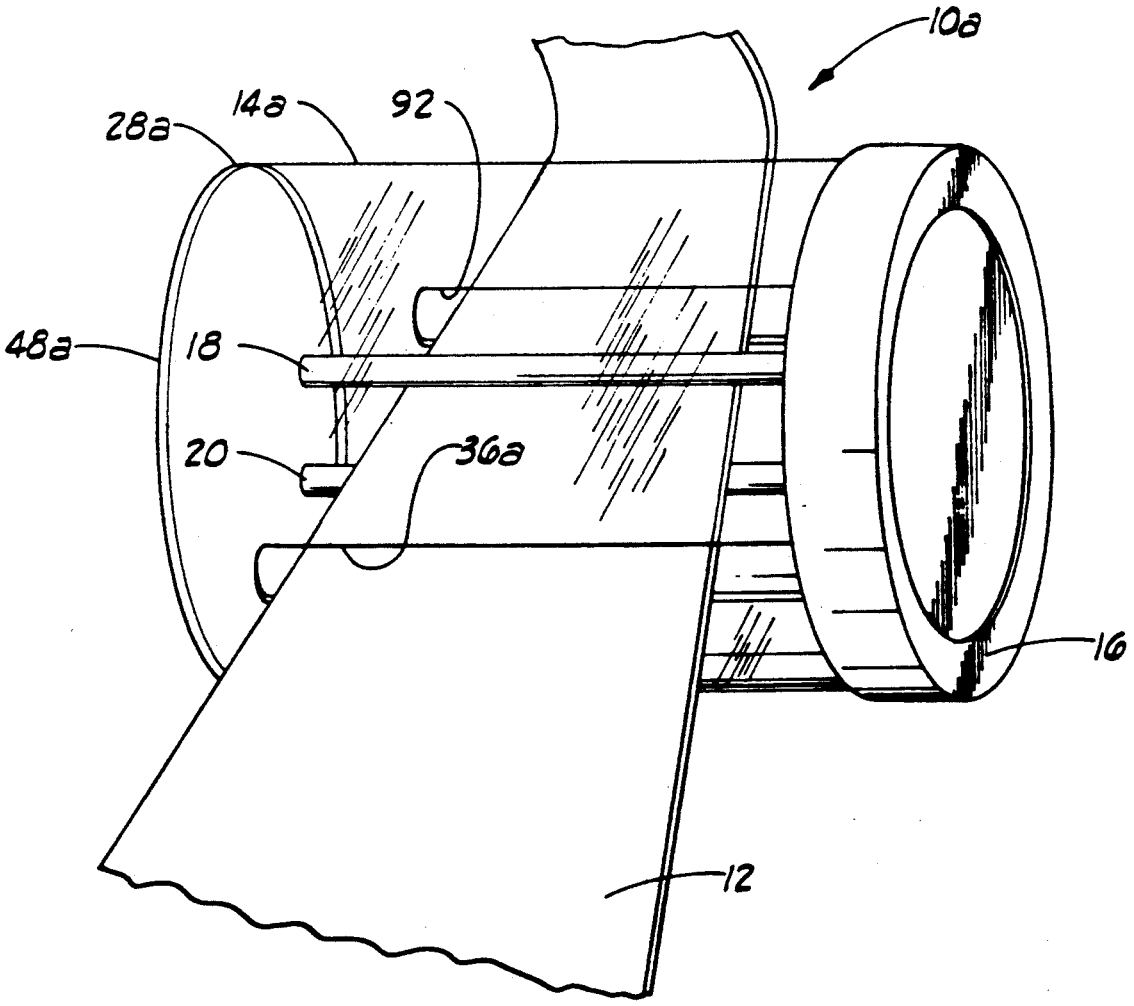
FIG. 8 is a perspective view of a modified storage apparatus constructed in accordance with the present invention.

Shown in FIG. 8 and designated therein by the reference numeral **10*a* is a modified storage apparatus. The modified storage apparatus 10*a* includes a lid 16*a* which is constructed exactly like the lid 16 described in detail before. The modified storage apparatus 10*a* includes a case 14*a* which is constructed exactly like the case 14 described in detail before, except the case 14*a* includes a second tie slot 92. The second tie slot 92 is formed through the outer peripheral surface of the case 14*a* and intersects the storage space formed in the case 14*a*. The second tie slot 92 intersects the first end of the case 14*a*. The second tie slot 92 extends a distance through the case 14*a* terminating with a second end which is spaced a distance from the base 14*a*. The second tie slot 92 has a slot width and a slot length which are identical to the slot width 44 and the slot length 46 described in detail before with respect to the tie slot 36. The case 14*a* also includes a first tie slot 36*a* which is constructed exactly like the tie slot 36 described before. The second tie slot 92 is spaced about 180° from the first tie slot 36*a* and the second tie slot 92 is aligned with the first tie slot 36*a***.

In operation, the necktie 12 is extended through the first slot **36*a* and through the second slot 92 with a portion of the necktie 12 extending between the first and the second tie rods 18 and 20. In this position, the lid 16 is rotated thereby wrapping the necktie 12 about the first and the second tie rods 18 and 20**.

Changes may be made in the construction and the operation of the various components, elements and assemblies described herein without departing from the spirit and scope of the invention as defined in the following claims.

What is claimed is:

1. A storage apparatus storing a necktie comprising:

a case having an outer peripheral surface, a first end and a second end with a case opening extending a distance through the case intersecting the first end of the case and forming a storage space within the case, a tie slot being formed in the case with the tie slot intersecting the outer peripheral surface of the case and intersecting the storage space with the tie slot having a first end intersecting the first end of the case and a second end spaced a distance from the second end of the case, the tie slot having a slot width and a slot length sized to slidingly receive the necktie;

a base connected to the second end of the case, the case having a case length extending between the first end of the case and the base;

a lid having an upper surface, a lower surface and an outer peripheral surface, the lid being removably connectable to the first end of the case;

a pair of rigid tie rods rigidly connected to the lower surface of the lid and extending a distance about perpendicularly from the lower surface of the lid, the tie rods being spaced a distance from one another, the tie rods being about equal in length and being spaced a distance from the base when the lid is connected to the base, the tie rods being unconnected to each other with the lid providing the only connection between the tie rods, the lid being rotatable to wind the necktie about the tie rods with the necktie being slidingly moved through the tie slot and between the tie rods as the necktie is wound about the tie rods until the necktie is wrapped about the tie rods and disposed in the storage space.

2. The storage apparatus of claim 1 wherein the tie rods each are defined further as being cylindrically shaped.

3. The storage apparatus of claim 1 wherein the case is further defined as being cylindrically shaped, and wherein the lid is further defined as being circularly shaped, and wherein the lid is defined further to include:

a lid flange extending about the outer peripheral surface of the lid, the lid flange extending a distance generally perpendicularly from the lower surface of the lid, a snap recess being formed in the inner surface of the lid flange and extending circumferentially about the lid flange; and wherein the case is defined further to include:

a snap flange formed on the outer peripheral surface of the case, the snap flange being disposed near the first end of the case and spaced a distance from the first end of the case and the snap flange extending a distance radially outwardly from the case, the snap flange being disposed in the snap recess when the lid is connected to the base with the lower surface of the lid being disposed adjacent the first end of the case.

4. The storage apparatus of claim 1 wherein the tie rods each are defined further as being integrally formed with the lid.

5. The storage apparatus of claim 1 wherein the case is defined further to comprise a second tie slot formed through the case intersecting the outer peripheral surface of the case and intersecting the storage space, the second tie slot having a slot width and a slot length sized to slidingly receive the necktie, and the second tie slot being aligned with the first tie slot, the necktie being extended through the first tie slot and the second tie slot and the lid being rotated thereby wrapping the necktie about the tie rods and disposing the necktie in the storage space of the case.

6. The storage apparatus of claim 1 wherein the base is continuous and substantially flat.

7. The storage apparatus of claim 6 wherein the base is integrally formed with the case.

* * * * *